US006244358B1

(12) United States Patent
Beer et al.

(10) Patent No.: US 6,244,358 B1
(45) Date of Patent: Jun. 12, 2001

(54) TRIGGER AND CLUTCH ARRANGEMENT FOR POWER TOOLS

(75) Inventors: Joshua M. Beer, Racine; Gordon A. Putney, Lake Geneva; Dennis A. Nowak, Greendale, all of WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/482,024

(22) Filed: Jan. 13, 2000

(51) Int. Cl.[7] ..... B25B 23/151

(52) U.S. Cl. ..... 173/178; 173/170

(58) Field of Search ..... 173/178, 170, 173/171, 48; 81/469, 473; 200/475, 522; 140/422; 188/77 W; 408/132

(56) References Cited

U.S. PATENT DOCUMENTS

| | | | | |
|---|---|---|---|---|
| 2,927,741 | * | 3/1960 | Moore et al. | 140/122 |
| 3,128,079 | | 4/1964 | De Groff | 415/123 |
| 3,386,298 | * | 6/1968 | Klingler | 173/170 |
| 3,724,560 | | 4/1973 | Tibbott | 173/178 |
| 3,998,565 | * | 12/1976 | Tanaka | 408/132 |
| 4,042,036 | * | 8/1977 | Smith et al. | 173/170 |
| 4,231,270 | | 11/1980 | Totsu | 81/474 |
| 4,265,320 | | 5/1981 | Tanaka et al. | 173/178 |
| 4,284,109 | * | 8/1981 | Kilmer et al. | 140/122 |
| 4,458,565 | | 7/1984 | Zilly et al. | 173/178 |
| 4,597,453 | | 7/1986 | Kilmer et al. | 173/171 |
| 4,650,007 | | 3/1987 | Fujita et al. | 173/178 |
| 4,683,660 | | 8/1987 | Schurr | 30/381 |
| 4,712,456 | * | 12/1987 | Yuan | 173/178 |
| 4,756,216 | | 7/1988 | Lo | 173/178 |
| 4,838,364 | * | 6/1989 | Hansson | 173/170 |
| 4,844,177 | | 7/1989 | Robinson et al. | 173/178 |
| 4,871,033 | | 10/1989 | Odoni et al. | 173/178 |
| 4,986,369 | * | 1/1991 | Fushiya et al. | 173/178 |
| 5,044,234 | | 9/1991 | Cheng | 81/473 |
| 5,358,062 | | 10/1994 | Uhl et al. | 173/178 |
| 5,406,674 | | 4/1995 | Lawter et al. | 15/410 |
| 5,915,795 | * | 6/1999 | Nakamura et al. | 188/77 W |
| 6,053,080 | * | 4/2000 | Kaneyama et al. | 81/469 |

* cited by examiner

*Primary Examiner*—Scott A. Smith
(74) *Attorney, Agent, or Firm*—Seyfarth Shaw

(57) ABSTRACT

A power tool is provided which includes a motor assembly having a rotatable motor shaft mechanism, and a motor control coupled to the motor assembly and operable between a normal off condition de-energizing the motor and an on condition energizing the motor. The tool includes a rotatable tool shaft mechanism, and a clutch shiftable between a normal disengaged condition decoupling the motor shaft mechanism from the tool shaft mechanism and an engaged condition coupling the motor shaft mechanism to the tool shaft mechanism. A trigger member is engageable with both the motor control and the clutch and is moveable between a first position, wherein the motor control is in its off condition and the clutch is in its disengaged condition, and a second position holding the motor control in its on condition and the clutch in its engaged condition for driving the tool shaft mechanism. The trigger member is designed to prevent premature energization of the motor assembly.

12 Claims, 5 Drawing Sheets

90
91
88
91
88
86
78
80
62
76
76
74
76
80
58
84
35
34
35a
35b
32
91a
30
29a
29
91a
104
100
106
98
104
106
40
41
41a
96
94
92
60
66
70
64
72
72
97

TRIGGER AND CLUTCH ARRANGEMENT FOR POWER TOOLS

BACKGROUND OF THE INVENTION

1. Field of the Invention

The present invention relates to power tools, and more particularly, to drive train couplers.

2. Description of the Prior Art

In the past, power tools have included trigger activated clutches to couple the motor shaft to the tool output shaft. These tools normally required a first trigger to engage the clutch and a second trigger to energize the motor and had very complicated clutching mechanisms.

These complicated clutch mechanisms were thus costly to make and complicated for an operator to use.

SUMMARY OF THE INVENTION

It is a general object of the invention to provide an improved trigger-operated power tool clutch arrangement, while affording structural and operating advantages.

An important feature of the invention is the provision of a trigger-operated power tool clutch which is of relatively simple and economical construction.

A further feature of the invention is the provision of a clutch of the type set forth which is not easily damaged in use.

Another feature of the invention is the provision of a clutch of the type set forth which includes a trigger which operates the motor as well as the clutch.

In connection with the foregoing feature, another feature of the invention is provision of a trigger of the type set forth which prevents premature energization of the tool motor.

Certain ones of these or other features may be attained by providing a power tool which includes a motor assembly having a rotatable motor shaft mechanism, and a motor control coupled to the motor assembly and operable between a normal off condition de-energizing the motor and an on condition energizing the motor. The tool includes a rotatable tool shaft mechanism, and a clutch shiftable between a normal disengaged condition decoupling the motor shaft mechanism from the tool shaft mechanism and an engaged condition coupling the motor shaft mechanism to the tool shaft mechanism. A trigger member is engageable with both the motor control and the clutch and is moveable between a first position, wherein the motor control is in its off condition and the clutch is in its disengaged condition, and a second position holding the motor control in its on condition and the clutch in its engaged condition for driving the tool shaft mechanism.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
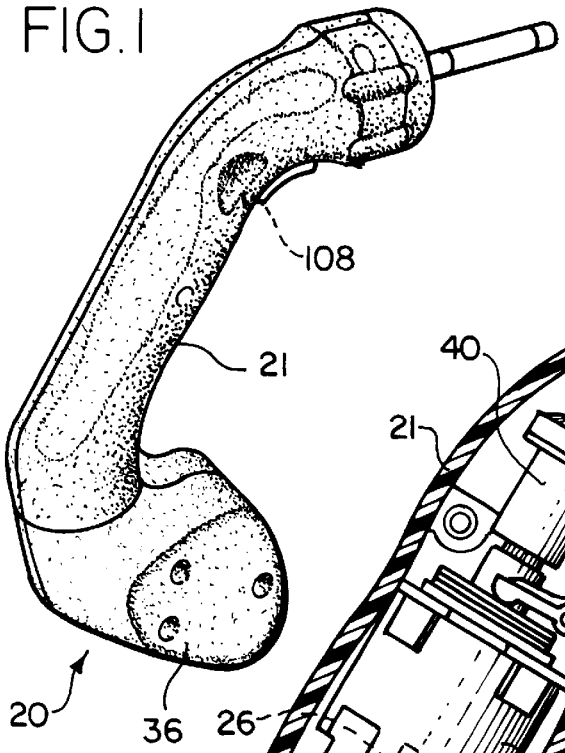
FIG. 1 is a perspective view of a power ratcheting screwdriver in accordance with the present invention.
Figure 2:
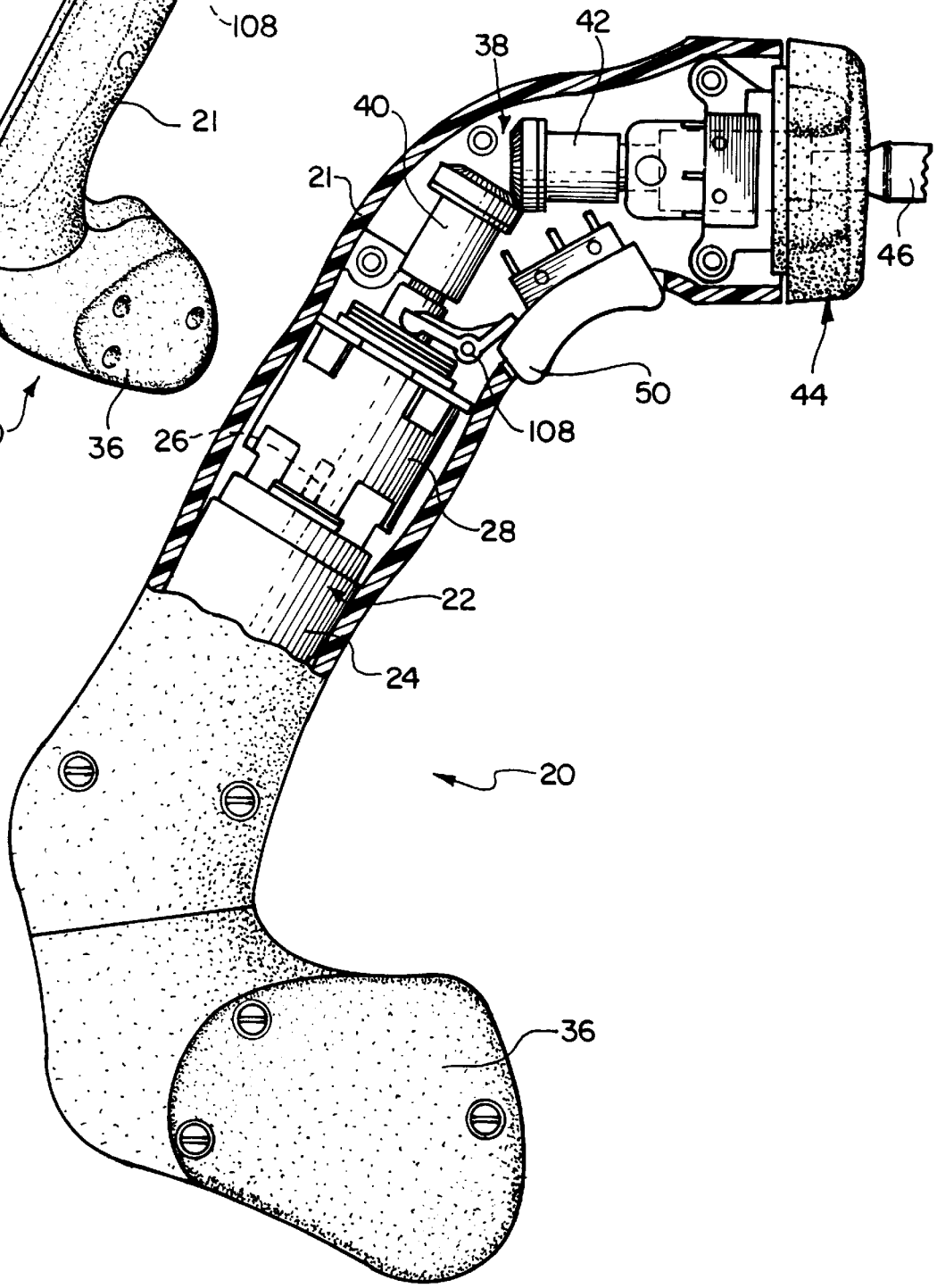
FIG. 2 is an enlarged, side elevational view, partially broken away, of the screwdriver of FIG. 1.
Figure 9:
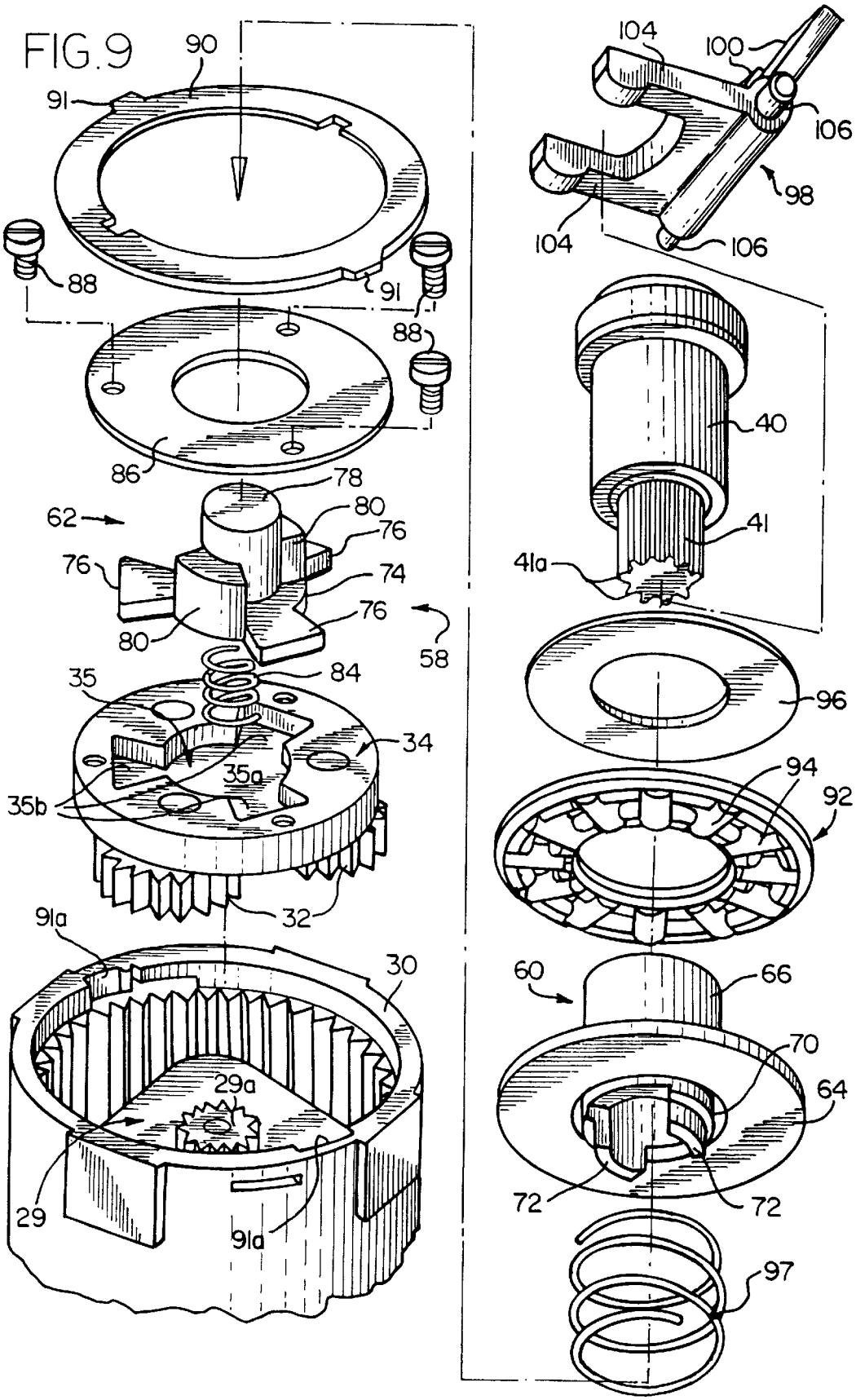
FIG. 9 is an exploded view of the clutch, the clutch actuator and a portion of the drive train assembly of the present invention.

Referring to FIG. 1, an electrically-powered ratcheting screwdriver 20 is illustrated. The screwdriver 20 includes an outer housing 21 enclosing a motor assembly 22. As seen in FIG. 2, the motor assembly 22 includes a DC motor 24. Referring also to FIG. 9, the motor assembly 22 also includes a motor shaft mechanism including a rotatable motor shaft 26 coupled to a drive train assembly 28, in a known manner. The drive train assembly 28 includes a first pinion gear (not shown) fixed to the motor shaft 26 and a first gear carrier 29 having planetary gears (also not shown) engaging the first pinion gear and a ring gear 30 to rotate the first carrier 29. A pinion gear 29*a* is fixed to the first carrier 29, and planetary gears 32, rotatably mounted on a second gear carrier 34, engage the pinion gear 29*a* and the ring gear 30 for rotating the carrier 34 in response to rotation of the motor shaft 26. The gear carrier 34 includes a cavity 35 having a central cylindrical portion 35*a* and three part-triangular arms 35*b*. As seen in FIGS. 1 and 2, the motor 24 is electrically powered by a battery pack 36.

As seen in FIG. 2, the ratcheting screwdriver 20 also includes a rotatable tool shaft mechanism 38 which includes, bevel gears 40, 42, coupled to a conventional ratcheting mechanism 44 including a bit holder 46. Bevel gear 40 includes, as seen in FIG. 9, a shaft 41 having a plurality of splines 41*a*.

Figure 3:
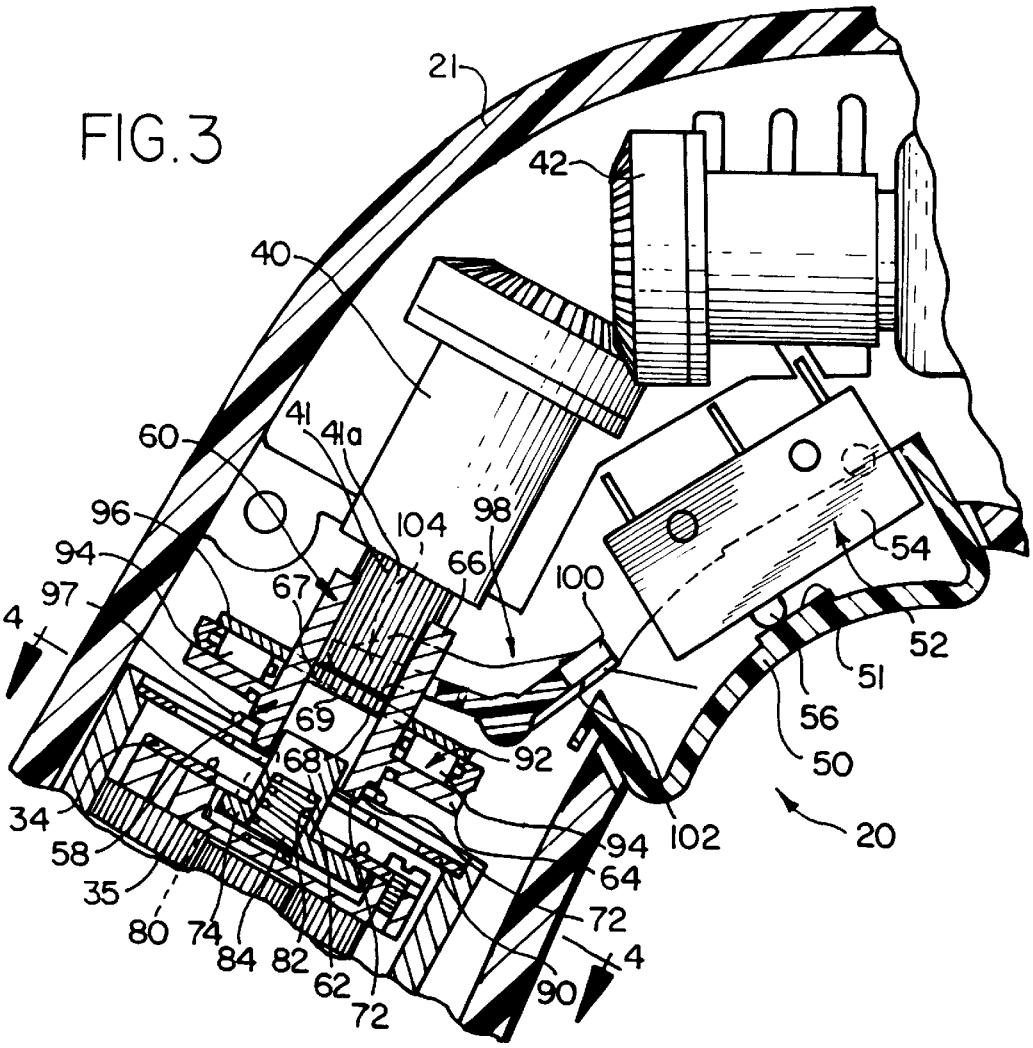
FIG. 3 is a further enlarged sectional view of a portion of FIG. 2 showing the clutch and the motor control of the present invention in a non-engaged and off conditions.
Figure 5:
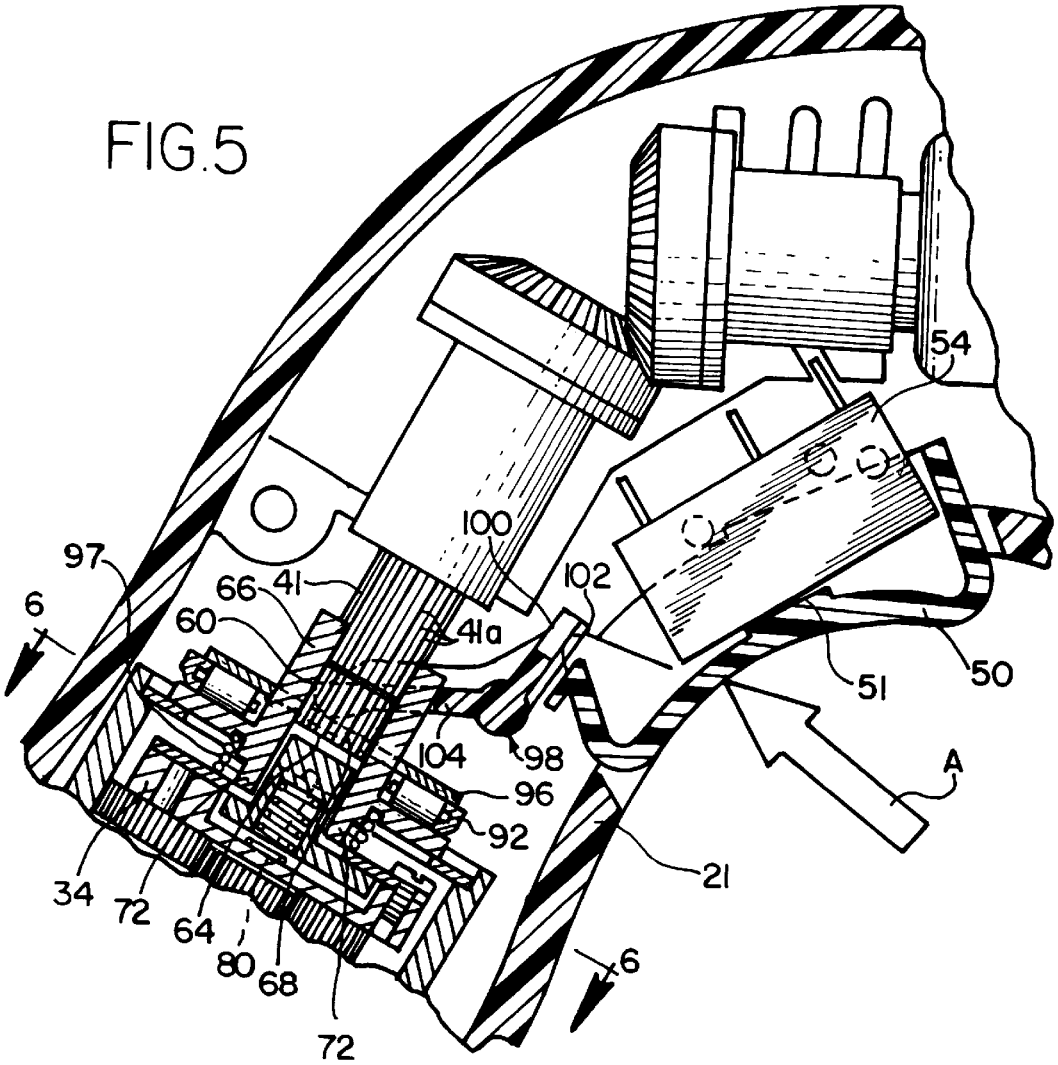
FIG. 5 is a view similar to FIG. 3 showing the clutch and the motor control in engaged and on conditions.
Figure 8:
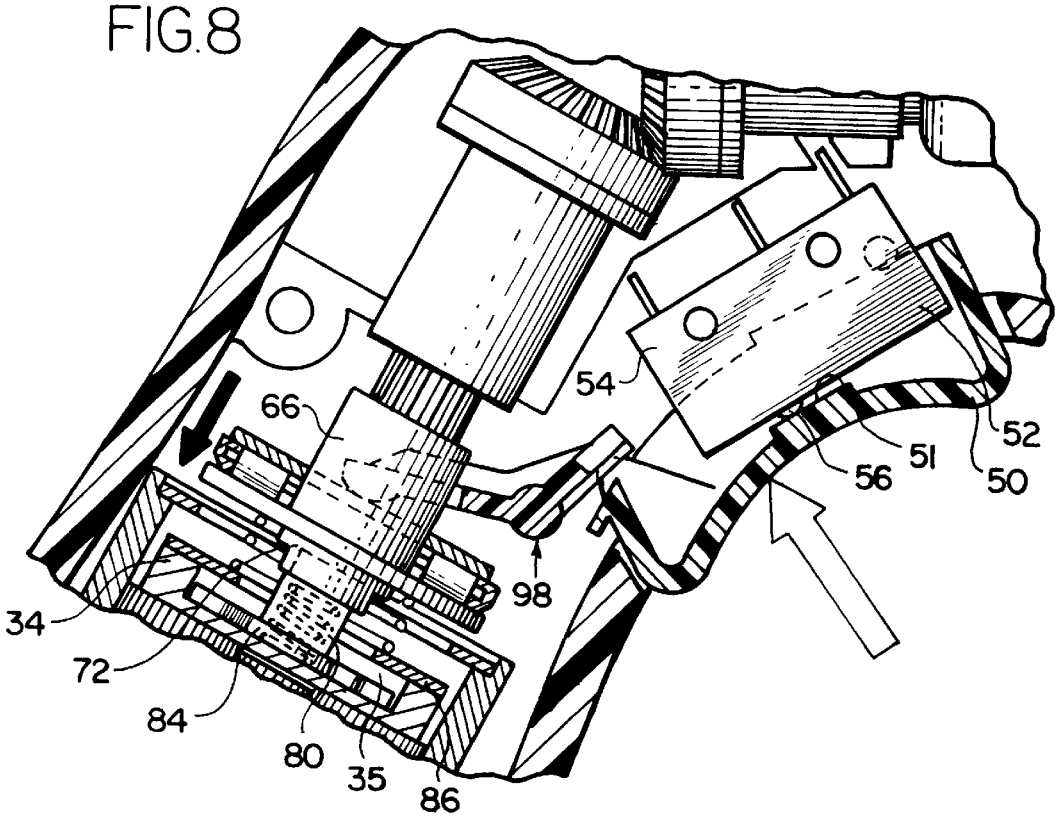
FIG. 8 is a view similar to FIG. 7, wherein the trigger has been further depressed and the motor control is in an on condition, and the clutch is not engaged.

Referring to FIG. 3, the ratcheting screwdriver 20 also includes a trigger button 50 having a pad 51 engageable with a motor control switch 52, electrically coupled to the motor 24 for energizing and de-energizing the same. The switch 52 includes a housing 54 and an actuator button 56. The button 56, as seen in FIG. 3, is normally biased out of the housing 54, to a normal off condition de-energizing the motor 24. The motor button 56, as seen in FIGS. 5 and 8 can be pushed into the housing 54 by the pad 51 of trigger button 50 to place the switch 52 in an on condition to energize the motor 24.

Referring to FIG. 9, the screwdriver 20 also includes a clutch 58 to couple the tool shaft mechanism 38 to the motor shaft mechanism. The clutch 58 includes a clutch driver 60 and a clutch jaws member 62. The clutch driver 60 includes an annular plate 64 and a hollow cylindrical collar 66 projecting axially from one side of the plate 64 and having a splined interior portion 68 (see FIG. 3). The clutch driver 60 also has an annular cavity 70 and two diametrically-opposed arcuate teeth 72 projecting axially from the other side of the plate 64. The splined interior portion 68 of the cylindrical collar 66 is disposed about and slidable axially on the splined shaft 41 of the bevel gear 40 such that the splines 41*a* are engaged with splines 69 (FIGS. 3 and 5), thereby coupling the clutch driver 60 to the tool shaft mechanism 38.

Referring to FIG. 9, the clutch jaws member 62 has a circular base 74 with three radially-projecting arms 76 and a central cylindrical portion 78 disposed on the base 74 having two diametrically opposed arcuate teeth 80 projecting radially outwardly therefrom. The central cylindrical portion 78 has a cylindrical cavity 82 formed axially in one end thereof (FIG. 3). As discussed below, the teeth 80 are engageable with the teeth 72 to couple the drive train assembly 28 and motor shaft 26 with the tool shaft mechanism 38.

A compression spring 84 is disposed in the cylindrical cavity 82 and bears against the gear carrier 34 at the central portion 35*a* of the cavity 35. A retaining plate 86 is disposed over the arms 76 and fastened by three screws 88 to the gear carrier 34. A retaining ring 90 has tabs 91 receivable in notches 91*a* in the ring gear 30 and is frictionally engaged with the ring gear 30 to maintain the gear carrier 34 and clutch jaws member 62 in place.

The spring 84 biases the clutch jaws member 62 outwardly, holding the arms 76 against the plate 86. The depth of the cavity 35 is such that the member 62 is slidably moveable axially thereinto.

The ratcheting screwdriver 20 also includes a thrust bearing 92 disposed upon the plate 64 and having a plurality of roller bearings 94 and a thrust washer 96 disposed upon the thrust bearing 92. The ratcheting screwdriver 20 also, as discussed further below, includes a compression spring 97 seated in the annular cavity 70 and bearing against the retained plate 86.

The ratcheting screwdriver 20 also includes a clutch actuator, in the form of a bell crank 98, which couples the trigger button 50 to the clutch 58. Referring to FIGS. 3 and 9, the bell crank 98 includes two arms 100 engageably coupled to a backside 102 of the trigger button 50 and two legs 104 straddling the cylindrical collar 66 and resting on the thrust washer 96. The bell crank 98 also includes two coaxially-aligned stub shafts 106 respectively disposed in cavities 108 in the housing 21 (FIGS. 1 and 2), the bell crank 98 being rotatable about the axis of the rods 106. Thus, the spring 97, acting through the clutch driver 60, the bearing 92 and the washer 96, urges the bell crank 98 against the trigger button 50. This bias, together with that of the switch actuator button 56, urges the trigger button 50 outwardly to the rest position of FIG. 3.

Figure 4:
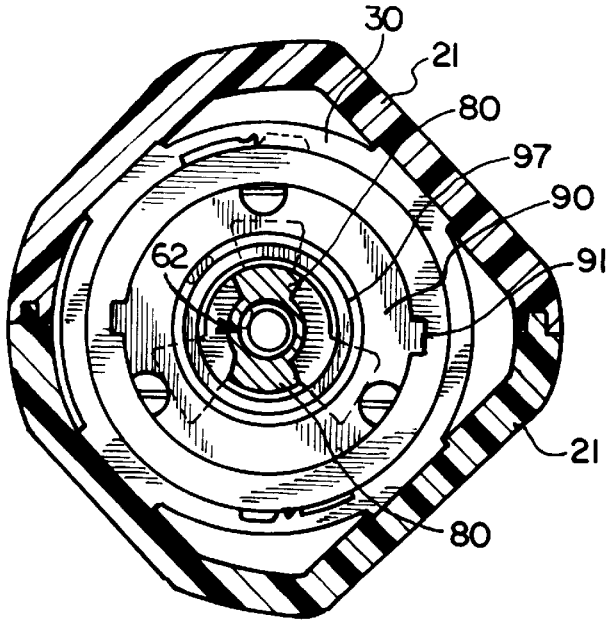
FIG. 4 is a sectional view taken generally along line 4—4 of FIG. 3.

The ratcheting screwdriver 20 operates as follows. As seen in FIGS. 3 and 4, when the trigger button 50 is not depressed, the switch 52 is in its off condition and the clutch 58 is in a disengaged condition wherein the tool shaft mechanism 38 is disengaged from the drive train assembly 28 and motor shaft 26. This is because the compression spring 97 biases the clutch driver 60 away from the clutch jaws member 62 so that teeth 72 of the clutch driver 60 are spaced axially from and not engaged with the teeth 80 of the clutch jaws member 62. The spring 97 biases the clutch driver 60, the thrust bearing 92, and the thrust washer 96 so that the thrust washer 96 exerts upward force against the legs 104 of the bell crank 98 whose arms 100 in turn exert biasing pressure on the backside 102 of the trigger button 50 so the pad 51 of the trigger button 50 is biased away from the button 56 of the switch 52 to allow the switch 52 to remain in its normal off condition.

Figure 6:
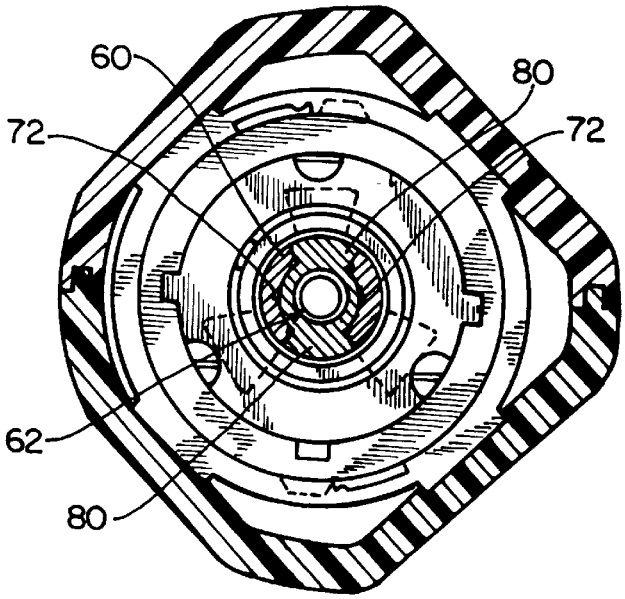
FIG. 6 is a sectional view taken generally along line 6—6 of FIG. 5.

Referring to FIGS. 5 and 6, when a user pushes the trigger button 50 in the direction of arrow A, the pad 51 pushes the button 56 of the switch 52 into the housing 54 to energize the motor 24 to rotate the motor shaft 26 and drive train assembly 28 including the gear carrier 34 in a known manner. At the same time, the backside 102 of the trigger button 50 pushes arms 100 to rotate the bell crank 98 counter-clockwise (FIG. 5) so that the legs 104 push the thrust washer 96, thrust bearing 92 and clutch driver 60 downward (still leaving splines 41*a* engaged with splines 69), compressing compression spring 97. If the rotational positions of the parts are such that teeth 72 are aligned perpendicular to the direction of alignment of the teeth 80, depression of the trigger button 50 causes the teeth 72 of the clutch driver 60 to move axially between the teeth 80 of the clutch jaws member 62 for engagement therewith.

The clutch jaws member 62 is trapped in and rotating with the gear carrier 34. The engaged teeth 72 and 80 cause the clutch driver 60 to rotate along with the bevel gear 40 which is engaged thereto via splines 41*a* and 69. Bevel gear 40 acts on bevel gear 42 to rotate the bit holder 46 in a known manner.

Figure 7:
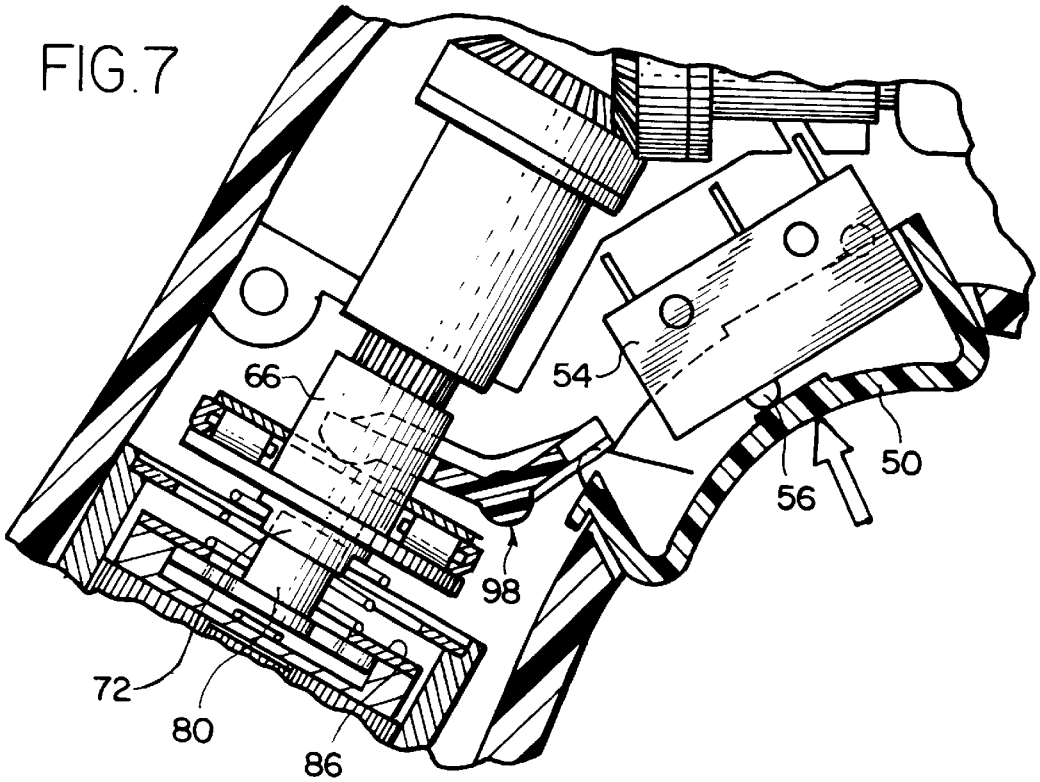
FIG. 7 is a view similar to FIG. 3 illustrating the trigger partially depressed and with the clutch in its non-engaged condition and the motor control in its off condition.

The bevel gear 40, clutch jaws member 62 and clutch driver 60 are coaxially aligned. As seen in FIG. 6, the teeth 72 of the clutch driver 60 and the teeth 80 of the clutch jaws member 62 are located at the same radial distance from the axis of rotation Z. Referring to FIGS. 7 and 8, since the teeth 72, 80 are at the same radial distance, and if they are not aligned perpendicular to each other, the teeth 72 may, as seen in FIG. 7, contact the axial end faces of the teeth 80 so when the trigger button 50 is first depressed, prior to the button 56 being pushed into the housing 54 a distance great enough to place switch 52 to its on condition.

To allow the motor 24 to be energized, the clutch jaws member 62 must be moved axially a distance great enough to allow the bell crank 98 to be rotated to allow the trigger button 50 to be depressed far enough to push the button 56 the distance needed to place the switch 52 to its on position. As seen in FIG. 8, when the trigger button 50 is depressed further, the teeth 72 of the clutch driver 60 force the teeth 80 and the clutch jaws member 62 axially downward into the cavity 35 of the gear carrier 34 against the urging of the spring 84, thereby allowing the button 56 to be depressed into the housing 54 a distance far enough to energize the motor 24. Thus, the motor cannot be energized until the teeth 72 are in axial position for engagement with the teeth 80. Once the motor 24 is energized, the clutch jaws member 62 is rotated, as previously described, and after it has turned about 90° its teeth 80 move to align with the spaces between the teeth 72 of clutch driver 60 and are pushed up into engagement by the spring 84 to the position shown in FIGS. 5 and 6.

The cross-sectional areas of central cylindrical portion 35*a* and part-triangular arms portion 35*b* of cavity 35 are respectively slightly larger than the cross-sectional areas of the base 74 and radially projecting arms 76 of the clutch jaws member 62 to provide clearance between the arms 76 and the part-triangular arm portions 35*b* of the cavity 35. This allows the clutch jaws member 62 to be inclined with respect to the axis of the gear carrier 34 so that the clutch jaws member 62 can properly engage the clutch driver 60 should there be any slight misalignment between the two.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A power tool comprising:

a motor assembly having a rotatable motor shaft mechanism;

a motor control coupled to the motor assembly and operable between a normal off condition de-energizing the motor and an on condition energizing the motor;

a rotatable tool shaft mechanism;

a clutch shiftable between a normal disengaged condition decoupling the motor shaft mechanism from the tool shaft mechanism and an engaged condition coupling the motor shaft mechanism to the tool shaft mechanism, the clutch including a clutch driver coupled to the tool shaft mechanism and a clutch jaws member coupled to the motor shaft mechanism, the clutch driver movable coaxially with respect to the clutch jaws member to engage the clutch jaws member in the engaged condition; and a trigger member engageable with both the motor control and the clutch, and moveable between a first position, wherein the motor control is in its off condition and the clutch is in its disengaged condition, and a second position holding the motor control in its on condition and the clutch in its engaged condition for driving the tool shaft mechanism, the trigger adapted to hold the motor control in its on condition only after the clutch driver is in axial position for engagement with the clutch jaws mechanism.

2. The tool of claim 1, wherein the clutch driver is moveable in response to movement of the trigger member.

3. The tool of claim 2, including a clutch actuator disposed between the trigger member and the clutch driver and responsive to movement of the trigger member to move the clutch driver to shift the clutch between the disengaged and engaged condition.

4. The tool of claim 3, wherein the actuator includes a lever having one arm engageably coupled to the trigger member and a second arm engageably coupled to the clutch driver.

5. The tool of claim 4, wherein the lever includes a bell crank.

6. The tool of claim 1, wherein the clutch further includes a splined shaft having an axis and coupled to the tool shaft mechanism and the clutch driver, the clutch driver including a splined collar engaged with the splined shaft and moveable along the axis of the splined shaft.

7. The tool of claim 1, wherein the motor assembly includes an electric motor and the motor control includes a switch.

8. The tool of claim 7, wherein the motor is battery powered.

9. A power tool comprising:

a motor assembly having a rotatable motor shaft mechanism;

a motor control coupled to the motor assembly and operable between a normal off condition de-energizing the motor and on condition energizing the motor;

a rotatable tool shaft mechanism;

a clutch having clutch portions respectively coupled to the motor shaft mechanism and the tool shaft mechanism, the clutch portions including a clutch jaws member and a clutch driver, each having teeth extending therefrom coaxially aligned and spaced for engagement with each other, the clutch driver moveable from a first position decoupled from the clutch jaws member and a second position permitting engagement with the clutch jaws member to couple the motor shaft mechanism to the tool shaft mechanism; and a trigger member engageable with both the motor control and the clutch driver and moveable between a first trigger position, wherein the motor control is in its off condition and the clutch driver is in its first position, and a second trigger position holding the motor control in its on condition and the clutch driver in its second position for driving the tool shaft mechanism, the motor control and the clutch driver being responsive to movement of the trigger to its second position, so that the motor control does not move to its on condition until the clutch driver is in its second position.

10. The tool of claim 9, wherein the clutch driver reaches its second position before allowing the trigger member to reach its second trigger position.

11. The tool of claim 10, wherein the clutch jaws member is biased to a rest position engageable with the clutch driver when the clutch driver is in its second position.

12. A power tool comprising:

a motor assembly having a rotatable motor shaft mechanism;

a motor control coupled to the motor assembly and operable between a normal off condition de-energizing the motor and on condition energizing the motor;

a rotatable tool shaft mechanism;

a clutch having clutch portions including a first clutch portion coupled to the motor shaft mechanism and axially movable with respect thereto and a second clutch portion coupled to the tool shaft mechanism and axially movable with respect thereto, a trigger member engageable with both the motor control and the second clutch portion, and moveable between a first position, wherein the motor control is in its off condition and the clutch is in its disengaged condition, and a second position holding the motor control in its on condition and the clutch in its engaged condition for driving the tool shaft mechanism.

* * * * *